United States Patent [19]

Komori et al.

[11] 4,400,351

[45] Aug. 23, 1983

[54] HIGH THERMAL RESISTANCE, HIGH ELECTRIC CONDUCTIVITY COPPER BASE ALLOY

[75] Inventors: Shinichi Komori, Ohmiya; Yasushi Shimanuki, Urawa; Isamu Suzuki, Yono, all of Japan

[73] Assignee: Mitsubishi Kinzoku Kabushiki Kaisha, Tokyo, Japan

[21] Appl. No.: 269,687

[22] Filed: Jun. 2, 1981

[30] Foreign Application Priority Data

Jun. 13, 1980 [JP] Japan ..... 55-79711
Dec. 1, 1980 [JP] Japan ..... 55-169402

[51] Int. Cl.[3] ..... C22C 9/00

[52] U.S. Cl. ..... 420/489; 420/494; 420/499; 420/500

[58] Field of Search ..... 148/11.5 C, 12.7 C; 420/494, 489, 500, 499, 469

[56] References Cited

U.S. PATENT DOCUMENTS

| | | | |
|---|---|---|---|
| 2,264,287 | 12/1941 | Betterton et al. | 75/153 |
| 2,479,311 | 8/1949 | Christensen et al. | 75/153 |
| 3,677,745 | 7/1972 | Finlay et al. | 75/153 |
| 3,773,503 | 11/1973 | Kranz et al. | 75/153 |

FOREIGN PATENT DOCUMENTS

| | | | |
|---|---|---|---|
| 454939 | 3/1949 | Canada | 420/469 |
| 49-27243 | 7/1974 | Japan | 420/489 |
| 56-266 | 1/1981 | Japan | 420/469 |

OTHER PUBLICATIONS

CDA, "The Effect of Research and Design on the Use of Copper on the Electrical Industry", Copper Development Assoc., Oct. 1962, 1962, pp. 15 & 22.

Mendenhall, *Understanding Copper Alloys,* Olin Corp., East Alton, Ill., 1977, p. 304.

*Primary Examiner*—Peter K. Skiff

*Attorney, Agent, or Firm*—Frishauf, Holtz, Goodman & Woodward

[57] ABSTRACT

An improved copper base alloy having excellent thermal resistance and electric conductivity. The alloy consists essentially of from 0.0005 to 0.01 percent boron, a material selected from the group consisting of phosphorus from 0.001 to 0.01 percent, indium from 0.002 to 0.03 percent, tellurium from 0.001 to 0.06 percent and mixtures thereof, and the balance copper and inevitable impurities. The copper base alloy may further contain from 0.002 to 0.05 percent magnesium whereby the magnesium imparts further enhanced thermal resistance to the alloy.

14 Claims, No Drawings

HIGH THERMAL RESISTANCE, HIGH ELECTRIC CONDUCTIVITY COPPER BASE ALLOY

BACKGROUND OF THE INVENTION

This invention relates to a copper base alloy which has high thermal resistance and high electric conductivity and is low in cost.

Cu-Ag alloys were conventionally used in the manufacture of various materials of which high thermal resistance and high electric conductivity are required, such as conductive materials for use in electronic parts and electric appliances, commutator bars, and coil windings.

However, due to the recent rise in the price of silver, it has become economically difficult to use silver so that nowadays silver finds use in a limited range of applications.

Attempts have been made to use Cu-Sn alloys or Cu-Fe-P alloys which are low in cost and excellent in thermal resistance, in the manufacture of the above-mentioned materials, in place of Cu-Ag alloys. However, these low cost copper base alloys are not satisfactory in respect of electric conductivity and therefore cannot perfectly supersede the Cu-Ag alloys.

OBJECT AND SUMMARY OF THE INVENTION

It is therefore the object of the invention to provide a low cost copper base alloy which does not contain silver, but possesses high thermal resistance and high electric conductivity.

According to the invention, there is provided a copper base alloy which consists essentially of (1) from 0.0005 to 0.01 percent, preferably from 0.0008 to 0.005 percent boron, (2) a material selected from the group consisting of phosphorus from 0.001 to 0.01 percent, preferably from 0.005 to 0.008 percent, indium from 0.002 to 0.03 percent, preferably from 0.01 to 0.03 percent, tellurium from 0.001 to 0.06 percent, preferably from 0.002 to 0.05 percent and mixtures thereof, and the balance copper and inevitable impurities.

In the above copper base alloy, the boron improves the thermal resistance of the alloy, while the phosphorus, indium and tellurium further enhance the thermal resistance of the alloy in coaction with the boron, without impairing the high electric conductivity possessed by the copper.

Further, the copper base alloy of the present invention may also contain, in addition to the above ingredients, magnesium in an amount from 0.002 to 0.05 percent, preferably from 0.01 to 0.03 percent, the magnesium further improving the thermal resistance of the alloy, in coaction with the boron and one or more of the phosphorus, indium and tellurium.

DETAILED DESCRIPTION

The composition of the alloys of the present invention is as stated heretofore. Throughout the instant specification all percentages of components are percentages by weight.

In the alloys of the present invention boron is present in an amount from 0.0005 to 0.01 percent, preferably from 0.0008 to 0.005 percent. Boron contributes to enhancement of the thermal resistance of the alloys. However, if the boron content is less than 0.0005 percent, desired values cannot be secured in respect of thermal resistance. Whilst, even if contained in an amount exceeding 0.01 percent, the boron does not serve to further enhance the thermal resistance of the alloys, and can even cause a degradation in the electric conductivity. Within a range of from 0.0008 to 0.005 percent, most satisfactory results can be obtained.

The alloys according to the present invention contain at least one material selected from the group consisting of phosphorus from 0.001 to 0.01 percent, indium from 0.002 to 0.03 percent, tellurium from 0.001 to 0.06 percent. Phosphorus, indium and tellurium alone or in combination act to further enhance the thermal resistance of the alloys in coaction with the boron and/or magnesium hereinafter referred to. However, if each of these components is contained in less than 0.001 percent phosphorus, less than 0.002 percent indium or less than 0.001 percent tellurium, the alloys cannot have improved thermal resistance as desired. Whilst, even if contained in excess of 0.01 percent phosphorus, 0.03 percent indium or 0.06 percent tellurium, these components are not effective in further improving the thermal resistance of the alloys, and can even cause not only a degradation in the electric conductivity and plastic workability of the alloys, but also a rise in the manufacturing cost. Within a range of from 0.005 to 0.008 percent phosphorus, from 0.01 to 0.03 percent indium or from 0.002 to 0.05 percent tellurium, particularly good results can be obtained.

The alloys of the present invention may further include from 0.002 to 0.05 percent magnesium. Magnesium acts to improve the thermal resistance of the alloys, as well as boron. However, if the magnesium content is less than 0.002 percent, desired values cannot be secured in respect of thermal resistance, whereas even if contained in excess of 0.05 percent, the magnesium does not further improve the thermal resistance of the alloys and can even cause a degradation in the electric conductivity. Within a range of from 0.01 to 0.03 percent, most satisfactory results can be obtained.

The present invention will be more clearly understood by referring to the following examples.

EXAMPLE I

Oxygen-free copper was melted according to an ordinary melting method. Added to the molten copper were boron and/or one or more ingredients of phosphorus, indium and tellurium in the preparation of copper base alloys of the present invention and copper base alloys for comparison, while added to the molten copper was silver in the preparation of a conventional Cu-Ag alloy, so that the resulting alloys have the final chemical compositions shown in Table 1. The molten copper with the above additives was cast according to a conventional casting method into ingots each having a size of 60 mm in diameter and 160 mm in length. The ingots thus obtained were subjected to hot extrusion at a temperature of 850° C. into bars each having a diameter of 8 mm. The bars were immediately quenched, followed by subjecting to drawing into wires, to obtain copper base alloys Nos. 1–18 according to the present invention, copper base alloys Nos. 19–24 for comparison and a conventional Cu-Ag alloys No. 25, each of which is in the form of wires having diameters of 2.6 mm and 1.0 mm. In each of the copper base alloys Nos. 19–24 for comparison, at least one of the alloy components is contained in an amount falling outside the scope of the present invention, whose content value is asterisked in Table 1.

Then, the respective wires of the copper base alloys Nos. 1–18 according to the present invention, the comparative copper base alloys Nos. 19–24 and the conventional Cu-Ag alloy No. 25 were cut into test pieces each having a diameter of 2.6 mm and a length of 250 mm for a softening point test and test pieces each having a diameter of 1.0 mm and a length in accordance with the test rules of Japan Industrial Standard (JIS) H 0505 for an electric conductivity test. These test pieces were subjected to a softening point test under the below-mentioned conditions and an electric conductivity test according to JIS H 0505.

TABLE 1

| Test Pieces | | Chemical Composition (weight %) Cu | B | P | In | Te | Ag | Softening Point (°C.) | Electric Conductivity (% I.A.C.S.) |
|---|---|---|---|---|---|---|---|---|---|
| Cu Alloys of the Present Invention | 1 | bal. | 0.0006 | 0.005 | — | — | — | 370 | 97.1 |
| | 2 | bal. | 0.0009 | 0.006 | — | — | — | 381 | 97.0 |
| | 3 | bal. | 0.0041 | 0.004 | — | — | — | 374 | 97.3 |
| | 4 | bal. | 0.0092 | 0.006 | — | — | — | 378 | 97.0 |
| | 5 | bal. | 0.0026 | 0.002 | — | — | — | 372 | 98.6 |
| | 6 | bal. | 0.0030 | 0.007 | — | — | — | 393 | 96.7 |
| | 7 | bal. | 0.0028 | — | 0.003 | — | — | 371 | 99.3 |
| | 8 | bal. | 0.0025 | — | 0.006 | — | — | 374 | 99.1 |
| | 9 | bal. | 0.0026 | — | 0.019 | — | — | 396 | 98.2 |
| | 10 | bal. | 0.0024 | — | 0.029 | — | — | 402 | 97.0 |
| | 11 | bal. | 0.0029 | — | — | 0.0020 | — | 389 | 99.0 |
| | 12 | bal. | 0.0028 | — | — | 0.0053 | — | 408 | 98.7 |
| | 13 | bal. | 0.0028 | — | — | 0.0258 | — | 447 | 98.0 |
| | 14 | bal. | 0.0027 | — | — | 0.0584 | — | 448 | 97.1 |
| | 15 | bal. | 0.0031 | 0.002 | 0.005 | — | — | 381 | 98.4 |
| | 16 | bal. | 0.0026 | — | 0.008 | 0.005 | — | 417 | 98.0 |
| | 17 | bal. | 0.0029 | 0.007 | — | 0.010 | — | 456 | 96.7 |
| | 18 | bal. | 0.0024 | 0.003 | 0.004 | 0.005 | — | 469 | 97.3 |
| Cu Alloys for Comparison | 19 | bal. | 0.0003* | 0.0051 | — | — | — | 296 | 96.8 |
| | 20 | bal. | —* | — | 0.010 | — | — | 326 | 99.0 |
| | 21 | bal. | —* | — | — | 0.0026 | — | 340 | 98.9 |
| | 22 | bal. | 0.026* | 0.0049 | — | — | — | 369 | 95.2 |
| | 23 | bal. | 0.022* | — | 0.019 | — | — | 372 | 95.8 |
| | 24 | bal. | 0.021* | — | — | 0.043 | — | 449 | 95.7 |
| Conv. Cu—Ag Alloy | 25 | bal. | — | — | — | — | 0.11 | 354 | 97.2 |

The softening point test was conducted as follows: A plurality of test pieces prepared from the aforementioned wires were heated in a furnace atmosphere at different temperatures for 60 minutes each. The heated test pieces were subjected to measurement of the tensile strength. Of the measured test pieces, a test piece was picked out which showed a sudden drop in the tensile strength relative to those test pieces heated at lower temperatures, and the heating temperature of the test piece picked out was judged as the softening point.

The results of the above-mentioned tests are all indicated in Table 1.

It is clearly noted from Table 1 that all the copper base alloys according to the present invention exhibit higher values in respect of softening point (thermal resistance) as compared with the conventional Cu-Ag alloy No. 25, while simultaneously exhibiting excellent values in respect of electric conductivity, which are equivalent to or higher than the same alloy No. 25. Whilst, the comparative copper base alloys Nos. 19–21, some of which do not contain boron and the other alloys have lower boron contents than the boron content range of the present invention, show inferior thermal resistance values, though they possess good electric conductivity. The comparative copper base alloys Nos. 22–24 which have higher boron contents than the boron content range of the present invention all show inferior electric conductivity values to the alloys of the present invention, though they have almost equivalent thermal resistance to the alloys of the present invention.

EXAMPLE II

Oxygen-free copper was melted according to an ordinary melting method. Added to the molten copper were boron, magnesium and one or more ingredients of phosphorus, indium and tellurium in the preparation of copper base alloys of the present invention, and one or more ingredients of boron, magnesium, phosphorus, indium and tellurium in the preparation of copper base alloys for comparison, respectively, while added to the molten copper was silver in the preparation of a conventional Cu-Ag alloys, so that the resulting alloys have the final chemical compositions shown in Table 2. The molten copper with the above additives was cast according to a conventional casting method into ingots each having a size of 60 mm in diameter and 160 mm in length. The ingots thus obtained were processed in a manner identical with that mentioned in EXAMPLE I to obtain copper base alloys Nos. 26–43 according to the present invention, copper base alloys Nos. 44–50 for comparison, and a conventional Cu-Ag alloy No. 51, each in the form of wires having diameters of 2.6 mm and 1.0 mm. In each of the comparative copper base alloys Nos. 44–50, at least one of the alloy components is contained in an amount falling outside the scope of the present invention, whose content value is asterisked in Table 2, like the comparative alloys in EXAMPLE I.

Then, the respective wires of the above-mentioned copper bases alloys were subjected to a softening point test and an electric conductivity test under the same conditions as in EXAMPLE I, results of which are shown in Table 2.

It is clearly noted from Table 2 that the comparative copper base alloys Nos. 44–50 are inferior in respect of either thermal resistance or electric conductivity to the alloys of the present invention, the inferior property values being marked with asterisks in Table 2, whereas the copper base alloys Nos. 26–43 according to the present invention exhibit satisfactory values in respect of both thermal resistance and electric conductivity. Particularly, the copper base alloys of the present invention all show excellent values in respect of electric conductivity, which are equivalent to or higher than that of the conventional Cu-Ag alloy No. 51, and far more excellent values in respect of thermal resistance than that of the conventional Cu-Ag alloy No. 51.

TABLE 2

| Test Pieces | | Chemical Composition (weight %) Cu | B | Mg | P | In | Te | Ag | Softening Point (°C.) | Electric Conductivity (% I.A.C.S.) |
|---|---|---|---|---|---|---|---|---|---|---|
| Cu Alloys of the Present Invention | 26 | bal. | 0.0008 | 0.011 | 0.0052 | — | — | — | 395 | 96.4 |
| | 27 | bal. | 0.0021 | 0.011 | 0.0051 | — | — | — | 402 | 96.4 |
| | 28 | bal. | 0.0053 | 0.012 | 0.0052 | — | — | — | 403 | 96.3 |
| | 29 | bal. | 0.0091 | 0.011 | 0.0050 | — | — | — | 403 | 96.2 |
| | 30 | bal. | 0.0021 | 0.0026 | 0.0053 | — | — | — | 389 | 96.7 |
| | 31 | bal. | 0.0022 | 0.043 | 0.0050 | — | — | — | 407 | 96.0 |
| | 32 | bal. | 0.0021 | 0.010 | 0.0017 | — | — | — | 394 | 97.5 |
| | 33 | bal. | 0.0021 | 0.010 | 0.0072 | — | — | — | 416 | 96.1 |
| | 34 | bal. | 0.0021 | 0.011 | — | 0.0023 | — | — | 392 | 97.9 |
| | 35 | bal. | 0.0022 | 0.010 | — | 0.011 | — | — | 415 | 97.3 |
| | 36 | bal. | 0.0021 | 0.011 | — | 0.027 | — | — | 421 | 96.4 |
| | 37 | bal. | 0.0021 | 0.010 | — | — | 0.0015 | — | 407 | 98.0 |
| | 38 | bal. | 0.0023 | 0.010 | — | — | 0.013 | — | 453 | 97.2 |
| | 39 | bal. | 0.0021 | 0.011 | — | — | 0.054 | — | 469 | 96.1 |
| | 40 | bal. | 0.0023 | 0.010 | 0.0050 | 0.011 | — | — | 427 | 96.2 |
| | 41 | bal. | 0.0021 | 0.010 | 0.0054 | — | 0.0033 | — | 444 | 96.1 |
| | 42 | bal. | 0.0022 | 0.011 | — | 0.010 | 0.0037 | — | 452 | 96.9 |
| | 43 | bal. | 0.0020 | 0.010 | 0.0050 | 0.010 | 0.0034 | — | 477 | 96.0 |
| Cu Alloys for Comparison | 44 | bal. | —* | 0.010 | 0.0048 | — | — | — | 345* | 96.4 |
| | 45 | bal. | 0.0006 | —* | 0.0051 | — | — | — | 370* | 97.1 |
| | 46 | bal. | 0.0021 | 0.074* | 0.0050 | — | — | — | 418 | 94.1* |
| | 47 | bal. | 0.0020 | 0.011 | —* | — | — | — | 361* | 98.7 |
| | 48 | bal. | 0.0021 | 0.010 | 0.014* | — | — | — | 433 | 91.3* |
| | 49 | bal. | 0.0020 | 0.010 | — | 0.041* | — | — | 439 | 94.3* |
| | 50 | bal. | 0.0020 | 0.011 | — | — | 0.080* | — | 471 | 94.9* |
| Conv. Cu—Ag Alloy | 51 | bal. | — | — | — | — | — | 0.22 | 364 | 96.5 |

As set forth above, the copper base alloys according to the present invention possess high thermal resistance and high electric conductivity and are inexpensive due to their exclusion of silver. Therefore, the alloys of the invention can fully take the place of conventional Cu-Ag alloys heretofore employed in articles of which high electric conductivity and high thermal resistance are required, and will find use in a wide range of applications in which they can exhibit excellent performances, thus being useful industrially.

1. A high thermal resistance, high electric conductivity copper base alloy consisting essentially of from 0.0005 to 0.01 percent boron, from 0.002 to 0.05 percent magnesium, a material selected from the group consisting of phosphorus from 0.001 to 0.01 percent, indium from 0.002 to 0.03 percent, tellurium from 0.001 to 0.06 percent and mixtures thereof, and the balance copper and inevitable impurities.

2. The copper base alloy as recited in claim 1, wherein the boron is present in an amount from 0.0008 to 0.005 percent.

3. The copper base alloy as recited in claim 1, wherein the magnesium is present in an amount from 0.01 to 0.03 percent.

4. The copper base alloy as recited in claim 1, wherein the phosphorus is present in an amount from 0.005 to 0.008 percent.

5. The copper base alloy as recited in claim 1, wherein the indium is present in an amount from 0.01 to 0.03 percent.

6. The copper base alloy as recited in claim 1, wherein the tellurium is present in an amount from 0.002 to 0.05 percent.

7. A high thermal resistance, high electric conductivity copper base alloy consisting essentially of from 0.0005 to 0.01 percent boron, from 0.002 to 0.03 percent indium, a material selected from the group consisting of phosphorus from 0.001 to 0.01 percent and tellurium from 0.001 to 0.06 percent and mixtures thereof, and the balance copper and inevitable impurities.

8. A high thermal resistance, high electric conductivity copper base alloy consisting essentially of from 0.0005 to 0.01 percent boron, from 0.002 to 0.05 percent magnesium, from 0.002 to 0.03 percent indium, a material selected from the group consisting of phosphorus from 0.001 to 0.01 percent and tellurium from 0.001 to 0.06 percent and mixtures thereof, and the balance copper and inevitable impurities.

9. A high thermal resistance, high electric conductivity copper base alloy consisting essentially of from 0.0005 to 0.01 percent boron, from 0.01 to 0.03 percent indium, and the balance copper and inevitable impurities.

10. The copper base alloy of claim 9 which also contains a material selected from the group consisting of phosphorus from 0.001 to 0.01 percent, tellurium from 0.001 to 0.06 percent and mixtures thereof.

11. A high thermal resistance, high electric conductivity copper base alloy consisting essentially of from 0.0005 to 0.01 percent boron, from 0.002 to 0.05 percent tellurium, and the balance copper and inevitable impurities.

12. The copper base alloy of claim 11 which also contains a material selected from the group consisting of indium from 0.01 to 0.03 percent, phosphorus from 0.001 to 0.01 percent and mixtures thereof.

13. A high thermal resistance, high electric conductivity copper base alloy consisting essentially of from 0.0005 to 0.01 percent boron, from 0.001 to 0.06 percent tellurium, a material selected from the group consisting of indium from 0.01 to 0.03 percent, phosphorus from 0.001 to 0.01 percent and mixtures thereof, and the balance copper and inevitable impurities.

14. A high thermal resistance, high electric conductivity copper base alloy consisting essentially of from 0.0005 to 0.0031 percent boron, a material selected from the group consisting of phosphorus from 0.001 to 0.01 percent, indium from 0.002 to 0.03 percent, tellurium from 0.001 to 0.06 percent and mixtures thereof, and the balance copper and inevitable impurities.

* * * * *